United States Patent [19]

Disén

[11] Patent Number: 4,457,249

[45] Date of Patent: Jul. 3, 1984

[54] METHOD OF FABRICATING AN INTEGRAL SHELL FORMED BODY AND THE BODY FORMED THEREBY

[75] Inventor: Sven R. Disén, Karlskrona, Sweden

[73] Assignee: K B Weecan Marine, Holmsjö, Sweden

[21] Appl. No.: 359,661

[22] PCT Filed: Jul. 8, 1981

[86] PCT No.: PCT/SE81/00211

§ 371 Date: Mar. 4, 1982

§ 102(e) Date: Mar. 4, 1982

[87] PCT Pub. No.: WO82/00313

PCT Pub. Date: Feb. 4, 1982

[30] Foreign Application Priority Data

Jul. 11, 1980 [SE] Sweden ..... 8005125
Sep. 17, 1980 [SE] Sweden ..... 8006517

[51] Int. Cl.[3] ..... B63B 3/18

[52] U.S. Cl. ..... 114/88; 52/588; 52/766; 114/356; 114/357; 138/154; 138/162; 138/165; 244/131; 403/380

[58] Field of Search ..... 114/79 R, 88, 356-358, 114/355; 52/762, 584, 588, 474, 482, 766; 403/380, 338, 345; 138/154, 162, 165, 166; 244/131, 132

[56] References Cited

U.S. PATENT DOCUMENTS

| | | | |
|---|---|---|---|
| 1,925,418 | 9/1933 | Swank | 52/584 |
| 2,354,485 | 7/1944 | Slaughter | 138/154 X |
| 2,905,579 | 9/1959 | Sumner | 114/358 X |
| 3,111,205 | 11/1963 | Gresham | 52/588 |
| 3,156,210 | 11/1964 | Lyon | 114/356 X |
| 3,190,408 | 6/1965 | Petterson | 52/482 |

FOREIGN PATENT DOCUMENTS

| | | | |
|---|---|---|---|
| 1245055 | 9/1960 | France | 114/88 |

*Primary Examiner*—Sherman D. Basinger

*Attorney, Agent, or Firm*—McCormick, Paulding & Huber

[57] ABSTRACT

A method for fabrication of an integral shell-formed body from several elongated panels (1, 2, 3), each of which along one longitudinal edge has a substantially U-formed tongue groove (6) and along the opposite longitudinal edge a tongue element (8) which is at least partly substantially narrower than the groove (6) thereby providing a clamp groove (12) when the tongue (8) is introduced in the tongue groove (6). One or more clamp blocks (13) can be introduced into the tongue groove to press the tongue (8) sideways and preferably also to the bottom of the groove (6). Preferably a layer of settable glue is provided between the groove (6) and the tongue (8), which glue layer is allowed to set after the groove and tongue elements have been clamped together by the clamp blocks (13). The clamp blocks can be formed as G-clips embracing and engaging the groove-tongue joint. The invention also relates to a body or hull structure especially for water and air conveyances made in accordance with the method from a number of elongated panels (44, 49, 50) and providing a closed hull body (41). The panels are preferably of even width and are formed with interacting groove and tongue elements (54, 55). The hull panels (44) are formed according to the intended hull profile and are located at an angle of 90–180 degrees in a polar plane in which the normal hull moving direction is 90 degrees. At the inner side of the hull body (41) the groove and tongue elements (54, 55) provide a rib-like pattern of projecting and reinforcing material portions (53, 55). The hull body may be built free supporting or may be formed with support frames (16), bulkheads or similar transverse members, and the hull panels extend around the entire hull body or the hull body may be divided into two hull portions which are connected by an outer joint plate, for instance, a keel plate (47), a border plate (48), or a stern plate (51). All joints of the hull body are secured by a glue joint, especially using a glue having a high shear strength.

12 Claims, 20 Drawing Figures

Fig. 15
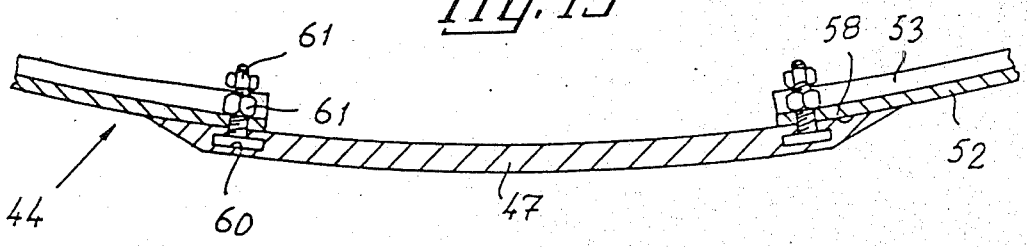
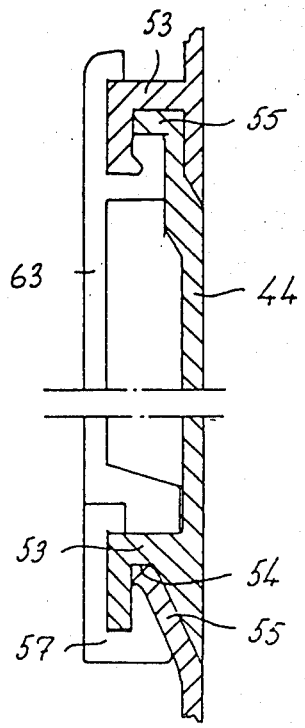
Fig. 17
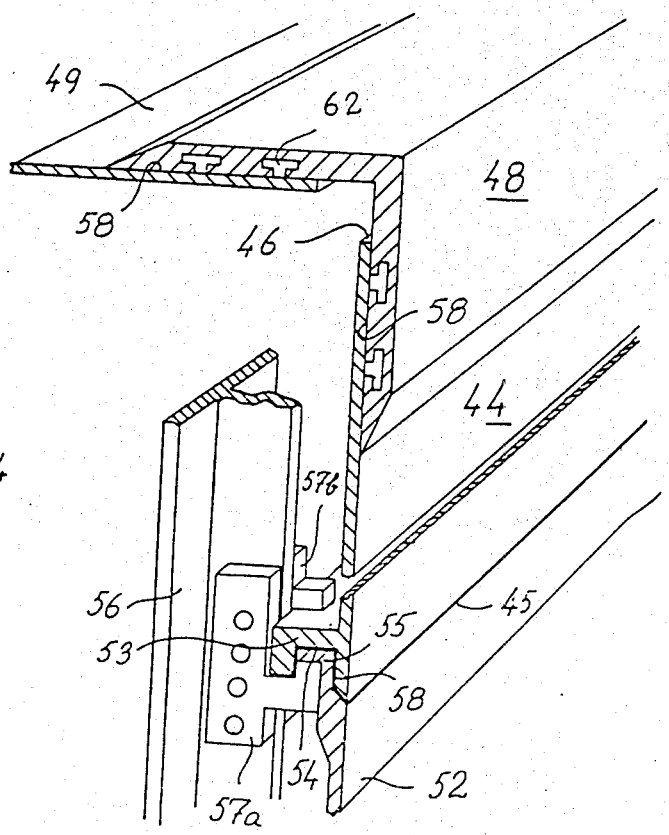
Fig. 16

METHOD OF FABRICATING AN INTEGRAL SHELL FORMED BODY AND THE BODY FORMED THEREBY

BACKGROUND OF THE INVENTION

The present invention generally relates to the fabrication of shell formed bodies, and the invention is particularly directed to the fabrication of integral shell formed bodies from a number of elongated panels which each along one longitudinal edge has a substantially U-formed groove and along opposite longitudinal edge has a rib or tongue for intermeshing the groove portion.

By shell formed body is meant in this connection any type of body whether shell or plate like and whether plane of curved. The expression is intended to include even bodies like pipes, containers, building structures, boats, ships, air planes etc.

The invention is intended for the fabrication of all kinds of shell-formed elements like walls, roofs or ceilings, floors etc. of buildings, shells, shelves, partition walls etc. of furniture or building components and many other purposes.

A special field within which the invention can be applied and is suitable is the fabrication of different parts of ships and small boats, for instance hulls, decks, bulkheads and plates, etc.

The invention also generally relates to a hull construction by what is meant in this connection any type of an integral and preferably sealed body.

The shell formed elements according to the invention may be fabricated from any conventional material but the invention is especially suited for use of plastic or any metal, in particular aluminum.

Integral shell-formed elements previously used to be fabricated from elongated panels of wood having groove and tongue connection means. Such shell formed elements generally necessitate some transverse joining element like a cross-rib for interconnecting the different panels. Also for giving the groove and tongue connection means sufficient strength the panel as an entire object has to be over-dimensioned. Such a structure therefore is heavy and bulky.

In turn, shell formed bodies of plastic, iron, aluminum or any other metal generally are fabricated by rivetting or welding narrow panels together. Riveting is a time consuming and expensive operation whereby it is necessary to either join the panels by overlapping joints or to use a special joining rib extending across the joint. For obtaining a sufficient strength and seal a very large number of rivets must be used. When welding panels a weakened zone of the panel is generally obtained aside of the weld. Usually it is therefore necessary to overdimension the material of the entire panel considering the strength of the weakest portion of the material. Often welding also gives heat strains which may provide weakened portions or stretchings or buckles of the welded panels. Therefore also welded or riveted constructions become heavy, uneven and un-necessarily expensive.

Attempts also have been made to join panels by gluing same together, but also in such cases it was thought that the joining had to be made by an overlap joint or by means of overlapping joining connections. Also, the gluing was not considered to give the same safety as a mechanical joint.

Panels of the above mentioned type can be made by molding or milling etc. but most economically they are generally made by extrusion. The panels may be of any suitable material which has sufficient bending and rupture strength to be suited as a hull material and as example of suitable materials may be mentioned different types of wood, platic, steel or some other metal. A specially suitable material is aluminum. By "hull" is in the present connection meant any type of an integral body which completely or partly is convexly formed at the exterior. The invention is suited for fabrication of different types of hull-structures like containers, resevoires and tubes etc. The invention is, however, especially suited for the fabrication of conveyances, especially fabrication of bodies for boats, airplanes, air-ships etc. where there are strong demands from the body structure to be water or gas proof, to have a low weight and to have great strength. In the following the invention therefore will mainly be described with reference to the fabrication of hull structures for boats etc., but it is to be understood that such description is only of examplifying nature and is not restricting the invention.

There are several principal methods of making hull structures. Hulls may be made by molding or baking in a concave mold or on a convex plug as for instance when fabricating plastic material boats. In such case, however, the size and form of the mold completely restricts the hull type. During molding often health endangering vapors appear, and the work often is rather time pressed since the molding generally must be made at least substantially continuously and at particular temperatures and climatic conditions.

A previous usual method of fabricating hull structures especially for boats is to join a large number of narrow boards of wood by riveting same and sometimes also gluing same generally with the assistance of frames. Also this method of making hull structures is time consuming and expensive both since the boards must be carefully formed according to the hull type, generally so that they are wider amidships than at the stem or stems and since a large number of rivets must be used. Also in this type of making hull structures there are some restrictions to a predetermined form and size of the hull. Also, in order to get a sufficient strength the hull becomes rather heavy in relation to the volume or buoyancy thereof.

The object of the invention therefore is to solve the problem of fabricating an integral shell formed body or hull structure from a number of elongated panels, the material of which need not be overdimensioned, which can be joined so that the surface of the body becomes even, which gives a completely sealed body, where the panels and thereby the shell formed body or hull structure is light but still strong and cheap to fabricate, and where the panels are flexible and may be adapted to different purposes. The method offers a great freedom in choice of fabricating method and enables within wide limits changes and reconstructions during the building of the hull, it allows fabrication of practically any form and type of hull, and the method is so simple that it is well suited even for non-experts to build hull structures.

SUMMARY OF THE INVENTION

To summarize the invention relates to a system for fabricating an integral shellformed body from several elongated panels, which system among other things is characterized in that the elongated panels along one edge have a substantially U-formed groove and along its opposite edge a tongue like element which is narrower than the U-groove and in which the tongue and groove elements of adjacent panels are adapted to provide a permanent joining of the panels in a method, in which the tongue and groove of the adjacent panels are interconnected, one or more press blocks are introduced in the space between one side of the groove and the tongue so that the tongue is pressed at least towards the opposite side of the groove and the press block or blocks are permanently maintained in the said space.

A particularly suited method of making a strong and water or gas proof joint is to apply a layer of thermo setting glue over the tongue and/or the groove before the panels are interconnected and heating the groove-tongue joint while maintaining the press action between the groove, the layer of glue and the tongue so that a fixed joint is obtained between the panels and the press block or press blocks. Often it may be useful also to apply a layer of thermo setting glue between the press blocks and the corresponding portions of the panel so that the entire shell formed body provides a solid integral unit.

As mentioned above the hull structure according to the invention is composed of a large number of light weight panels of groove-tongued type which are joined to form preferably a water-proof body. In order to obtain an even outside of the hull the groove-tongue portions are formed as flanges at the inside of the panel, and when joined the groove-tongue portions provides an inner rib like formation which stabilizes the hull so that the hull may even be used without any frames or other types of reinforcements. Designing the hull structures by the said panels offers a practically unlimited possibility of choosing the method of fabricating the hull. It may be built inside a concave die, it may be built outside a convex plug, it may be built on frame jigs, it may be built on auxiliary frames which are removed after the hull is built, it may even be built free hand or by means of separate test jigs, it may be built starting with the stem, the stern or anywhere between the said portions of the hull, it may be built correctly turned up or turned upside down etc.

In order to give a hull which is as light and at the same time as strong as possible it is important that the special strength properties of the material are used in the best possible way. The joint between groove and tongue of course offers the best shearing and tension strength in the longitudinal direction of the joints, and therefore the joints of the hull structure should be located so as to extend parallel or almost parallel to the largest force component that the hull is subjected to for the largest part of the hull structure. For ships, airplanes, airships, etc. the direction of the said largest force component can be calculated to extend in the moving direction of the conveyance from a horizontal plane down to a vertical plane, in other words between 270° and 360° as appearing in a polar system with the moving direction of the conveyance at 90° as seen in such polar system the panels therefore ought to be located at a polar angle between 90° and 180° with the conveyance moving in an angle of 90°.

The hull may be built with even plane surfaces, but the invention is also suited for building rounded surfaces. When building rounded hull surfaces the panels can be allowed to extend at the said angle around the entire hull body or they may at special places be joined by means of special joining elements, for instance by means of a keel plate and/or at the deck by means of a boarder or deck plate.

Further characteristics of the invention will be evident from the following detailed description in which reference will be made to the accompanying drawings. It should, however, be noted that the specification and the embodiments of the invention illustrated in the drawings are only of examplifying natures and that all types of modifications may be presented within the scope of the appended claims.

BRIEF DESCRIPTION OF THE DRAWINGS

In the drawings

FIG. 15 shows a vertical view through a keel plate and hull panels connected thereto.

FIG. 16 shows a little portion of a joint between the shell plating and the deck of a boat, and FIG. 17 shows a method of providing a reinforcement of the hull panels.

DESCRIPTION OF THE PREFERRED EMBODIMENTS

Figure 1:
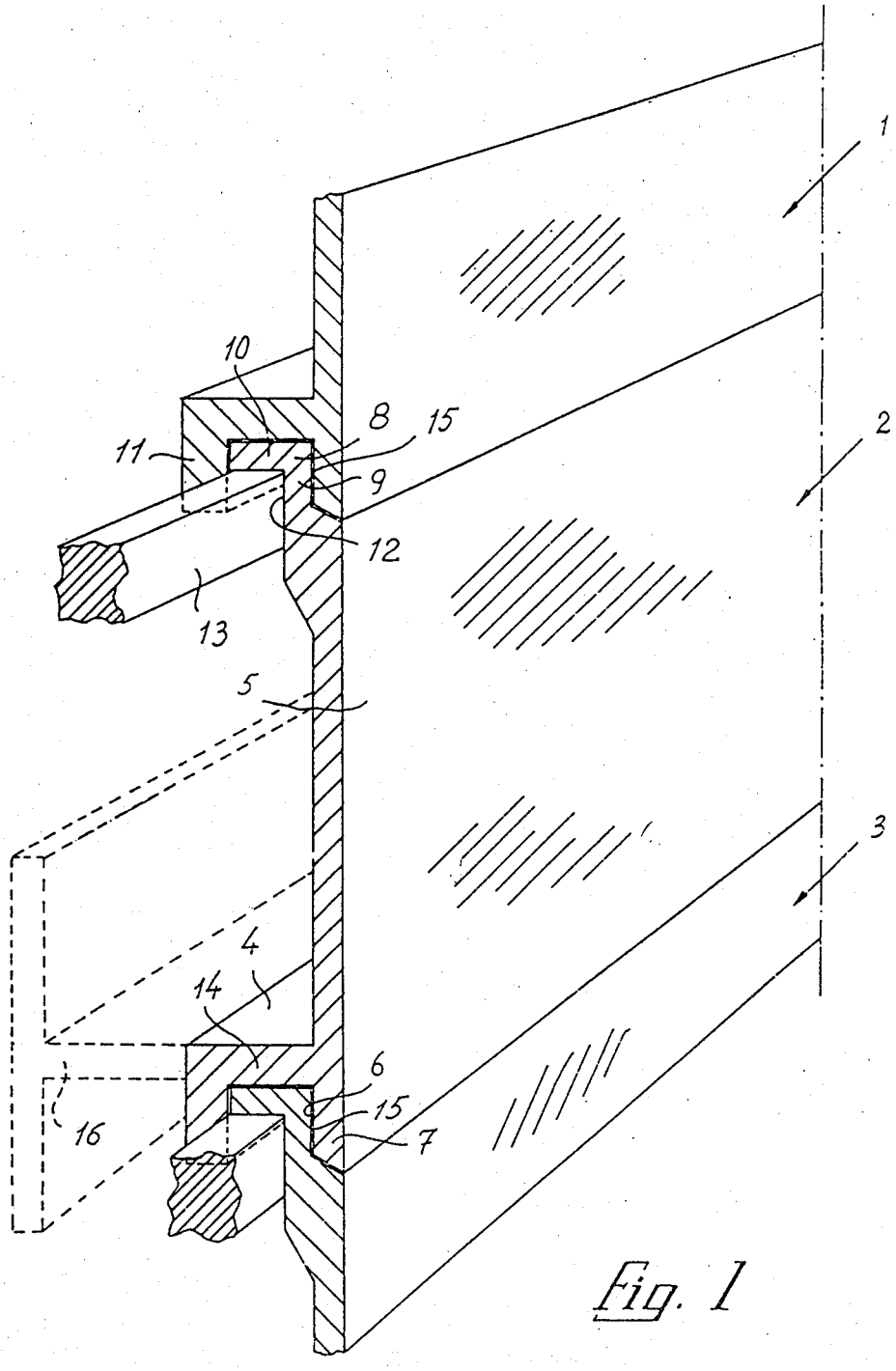
FIG. 1 diagrammatically and in a perspective view shows one side of a shell formed body made in accordance with the invention, and FIG. 2 likewise diagrammatically and in a perspective view shows the opposite side of a shellformed body made according to an alternative method of the invention.

In FIG. 1 is diagrammatically shown a shell formed body made of three elongated panels 1, 2 and 3 of which only a little portion is shown. The panels may be made of glued formed pressed or in any other way provided wood material, but preferably the panels are molded or extruded profiles of plastic, aluminum or some suitable alloy. For ships or boats profiles of light metal like for instance marine aluminum is considered an especially suited material. The panels have a thickness over the entire surface which is determined by ordinary strength calculations for the material in question, and the panel consequently is not unnecessarily overdimensioned. Along one edge the panel is formed with a female connection means 4 in the form of an angle branch extending from the main plane of the panel and which provides a substantially U-formed groove 6 together with the lowermost portion 7 of the main plane of the panel. Along its opposite longitudinal edge the panel has a male connection means 8 in the form of an inversed L-formed tongue extending from the main plane 5 of the panel and the leg 9 of which is substantially as long as the lower-most main plane portion 7 and the foot 10 has a width which is the same as or preferably smaller than the width of the groove 6. Preferably the male connection means 8 is offset some distance from the main plane 5 in the same direction as the female connection means 4 and a distance substantially corresponding to the thickness of the lower-most portion 7 of the main plane 5. The lower side of the bottom flange 7 and the upper side of the main plane 5 can be formed sloping as shown in the figure so as to give a prolonged sealing surface, and if wanted the angle of the bottom flange 7 to the main plane 5 may be larger than the corresponding angle of the upper edge of the main plane so that the densest possible contact is obtained between the panels at the even outer surface of the shell formed body.

The foot 10 of the tongue 8 is substantially thinner than the height of the outer side portion 11 of the female connection means 4 providing a clamp groove 12 for the interconnected tongue and groove portions in which clamp groove one or more clamp blocks 13 can be introduced.

In case the panels are joined without the use of a layer of glue between the tongue and groove portions and between the clamp blocks and the corresponding panel portions respectively the web portion 14 of the groove may alternatively be heated so as to expand whereupon the clamp block or the clamp blocks are introduced in the clamp groove 12.

When setting up the shell formed body the tongue 8 is introduced in the groove 6 of the adjacent panel, the foot 10 of the tongue is pressed to the bottom of the groove, and thereafter one or more clamp blocks 13 are introduced in the clamp groove 12, whereby the tongue is pressed also to the bottom flange 7 of the panel. The clamp blocks 13 may be slightly conical wedges which are forced into the clamp groove 12, or they may be plane parallel ribs which are introduced in the clamp groove in a cooled down state so that the ribs later adopting the same temperature as the panels have expanded to provide a permanent clamp joint between the tongue 8 and the bottom flange 7 and the bottom or web portion 14 of the panel respectively. In the latter case the clamp block or blocks are formed slightly wider than the nominal width of the clamp groove 12.

Alternatively the web portion 14 of the groove may be heated to be expanded whereupon the clamp block or blocks are introduced in the groove 12. The clamp blocks 13 may be short pieces of metal ribs, but they may also be long ribs extending along the entire length of the panel.

In order to obtain a safer and better sealed joint a layer 15 of glue is preferably provided on one side between the bottom portion 14 of the groove and the bottom flange 7 of the panel and on the other side between the foot 10 and the leg 9 of the tongue. In a particularly preferred embodiment of the invention a setting layer of glue, for instance a foil of glue is applied on the tongue 8 before introducing the tongue in the groove 6, and after the two parts are engaged the panels are clamped together as described above by means of the clamp blocks 13. Thereafter the shell formed body is heated along one joint portion or preferably as a complete to such temperature the glue sets and upon pressure from the clamp blocks gives a strong glue joint in addition to the mechanical joint provided by the interaction of groove 16, tongue 8 and clamp blocks 13. A shell formed body fabricated accordingly is light and strong and can be handled as a solid unit. The shell formed body, however, can be built successively at any place of working by successively joining several panels, and in such case the setting of the glue layers 15 preferably is provided for all joints together after all panels of the shell formed body have been joined mechanically.

The panels also can be formed with longitudinal extending runners for instance T-formed runners 16 as indicated with the dotted lines of FIG. 1. By means of such runners or projecting bars the shell formed body can be mounted in a suitable way, and between the runners 16 an insulation material and interior finish may be mounted upon need.

It should be pointed out that the panels 1, 2 and 3 can be mounted lying as shown in the figures or standing or at any angle to the horizontal plane and the vertical plane respectively.

Figure 2:
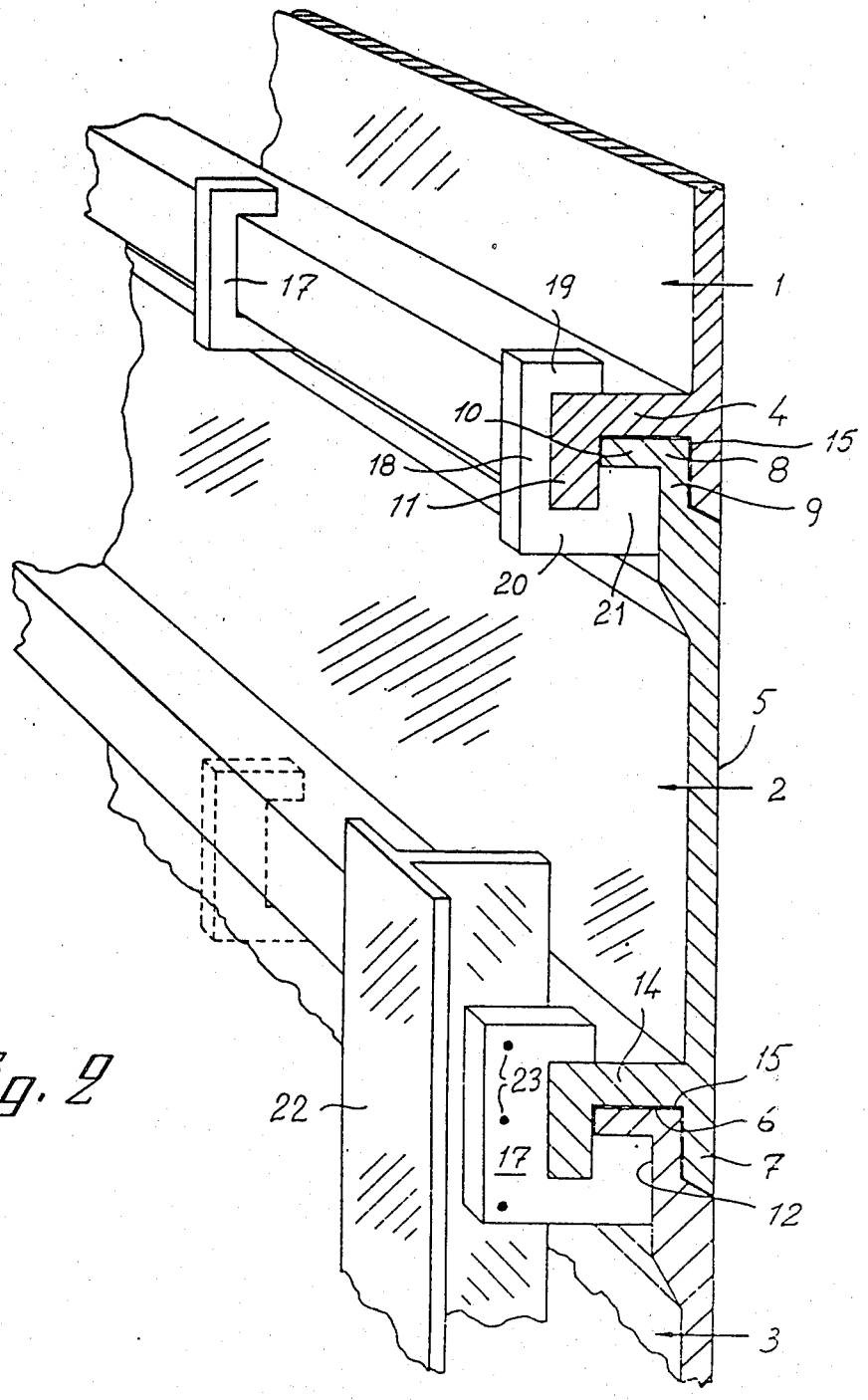

In FIG. 2 an alternative method and apparatus according to the invention is illustrated. In this case the panels 1, 2 and 3 basically are joined as described above, but here the clamp blocks are substituted by G-formed clips 17 having a web portion 18, an upper branch 19, a lower branch 20 and a clamp block portion 21. The upper branch 19 contacts the upper side of the web 14 of the male connection means 4, and the clamp block portion 21 presses the inversed L-formed tongue 8 up to the bottom of the groove 6 and out to the bottom flange 7 of the panel. The G-clips 17 may be made of the same material as the panels or of any other material, and they are preferably made of a high strength material having some spring action. In the lower half of FIG. 2 is shown a method of mounting the shell forming elements on a vertical rule, a boat frame 22 or any similar means. In this case the web portion 18 of the G-clip is somewhat widened and the clip is mounted in the rule by means of rivets 23, screws or bolts.

The building and the mounting of the shell formed body shown in FIG. 2 is made as follows: The tongue 8 or the groove 6 of one panel is supplied with a layer 15 of a setting glue and the tongue 8 of one panel is introduced in the groove 16 of the adjacent panel. The foot 10 of the tongue is pressed to the bottom of the groove 6 with the aid of some suitable tool, and from aside a suitable number of G-clips are introduced. The G-clips may be formed as an elongated rib extending along the entire joint of the panels, or they may be short pieces of clips as shown in FIG. 2. In the latter case preferably short or long clamp blocks substantially of the same type as in FIG. 1 can be pressed into the clamp groove 12 between the G-clips 17. If an extremely good sealed and strong joint is wanted a clamp block of the same length as the distance between the G-clips can be pressed into the clamp groove 12. The large or small separate clamp blocks 13 can be introduced in the clamp groove in such cooled state that they after having obtained construction temperature provides the intended clamp action. If wanted the shell formed body can be mounted on frames 22 or rules in that the G-clamps 17 are rivetted, screwed or in any other way secured to the frames. If needed final adjustments of the body can be made in that separate clamp blocks are introduced between the G-clips. The even outer surface of the body thereby provided normally does not need to be ground, putted or painted.

Figure 3:
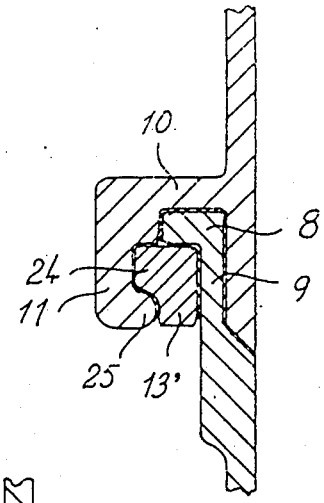
FIGS. 3, 4 and 5 shows the different embodiments of keys and press blocks.

In FIG. 3 is shown how the clamp block 13' is formed with a nose 24 opposite to the plane of the panel which nose engages above and behind a corresponding nose or shoulder 25 at the end of the outer side 11 of the female connection means. Such coupling means gives a very strong and safe joint, especially if a foil of glue is applied over the entire joint surface between the clamp blocks on one hand and the male and female connection means on the other hand.

Figure 4:
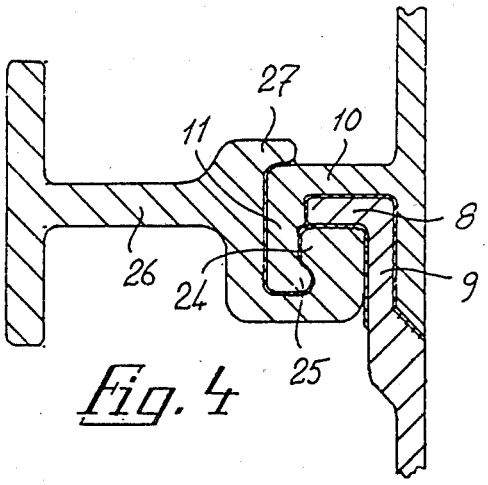

FIG. 4 shows the clamp block of G-clip formed with a T-bracket projecting from the plane of the panels, which bracket blocks in one hand and the male and female connection means on the other hand.

FIG. 4 shows the clamp block or G-clip formed with a T-bracket 26 projecting from the plane of the panels, which bracket may serve as a support or a carrier arm for the shell formed body or in which all kinds of different means like insulation material etc. can be mounted and supported. In this case it has been possible to reduce the upper overhang of the G-clip so that the clip can be heeled onto the female connection means without the need of moving the clip into place from the side.

Figure 5:
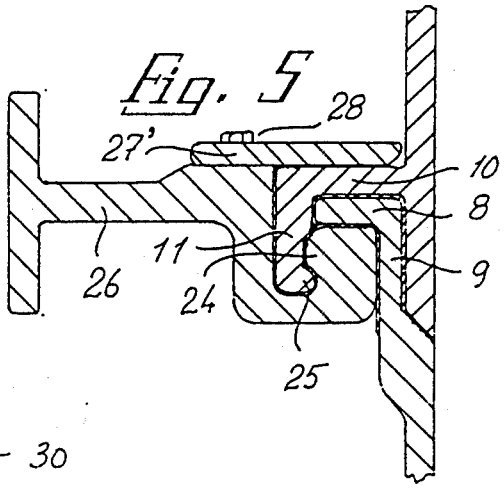

FIG. 5 shows an altenative clamp block having a support bracket, in which the upper overhang of the G-clip has been substituted by a separate rib 27' which by means of a screw 28, a rivet or by any other means is mounted in the bracket 26 after the clip is mounted in the connection joint. The said rib 27' extends over the web 14 of the female connection means 4 and guarantees that the clip cannot be released therefrom.

Figure 6:
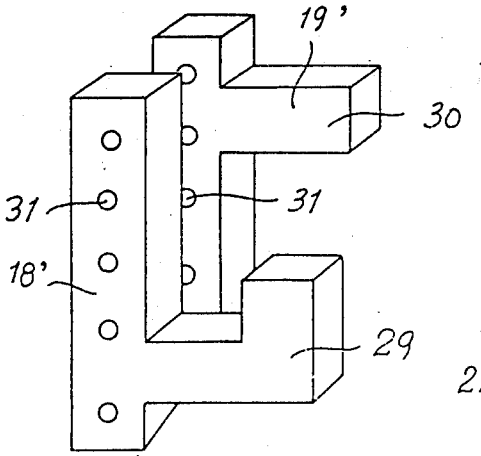
FIGS. 6 and 7 illustrates a further alternative method of joining the panels according to the invention.
Figure 7:
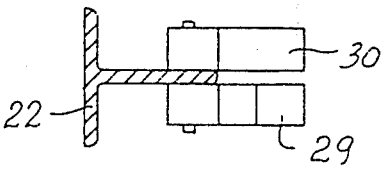

FIGS. 6 and 7 show an alternative embodiment of the above described G-clip. In this case the clip is formed by two parts, a lower hook 29 which as described above is adapted for being introduced in the clamp groove between two panels, and an upper hook 30 which is adapted to be mounted in the web portion 18' of the lower hook 29 and to contact the upper side of the web portion 14 of the female connection means by an upper branch 19'. For this purpose both the lower and the upper hook is formed with bores 31 for engagement with screws or bolts. This embodiment of the G-clip allows an assembling of panels having different sides of the connection means.

The joining clip shown in FIGS. 4, 5 and 6 makes it possible to reduce the material of the coupling means since the coupling means are subjected to very little torque stress at mounting and use when the said clips are used. The clip itself provides the main supporting mounting means.

Figure 9:
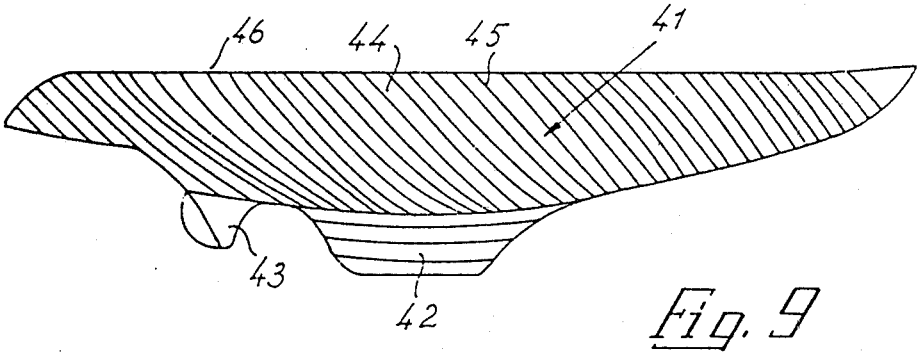
FIG. 9 diagrammatically and in a side view shows a sailing boat hull designed and made in accordance with the invention.
Figure 8:
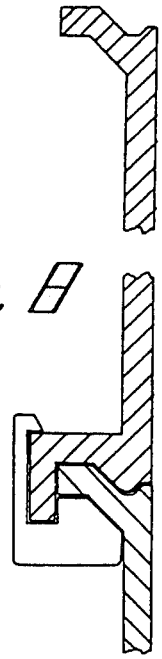
FIG. 8 shows another type of panel and a key for maintaining such panels interconnected.

In FIG. 9 is shown a sailing boat hull having a hull body 41, a keel 42 and a rudder 43. The hull body is composed of a large number elongated and even wide hull panels 44 having at their longitudinal edges groove-tongue connection elements. The panels are bowed following the intended hull form and are connected by means of the said groove-tongue elements.

In means of conveyance, especially in boats, airplanes, airships etc. the hull is subjected to complex forces a dominating and serious force component of which normally or at least under unfavourable circumstances is directed at an angle from the horizontal direction and straight to the direction of the hull movement and down to the direction vertically towards the hull, i.e. in a polar angle system so that the said dominating force component is directed between 270° and 360° supposing the conveyance is moved at 90° of said polar system. Since the joints between the panels have their greatest strength in the longitudinal direction of the joint and the joints further are the weakest point of the structure it is essential that the joints are directed as close to a parallel direction to the said dominating force component as possible. According to the invention the hull panels 4 therefore should be located so that their joints 45 in the said polar angle system extend at an angle from 90° and down to 180°. For resistance reasons and for avoiding the need of using extremely long hull panels and for avoiding cross joints in the longitudinal direction the hull panels 44 are preferably located at an angle of between 120° and 180° in the said polar angle system. According to the form of the hull the angle of the panels may vary slightly along the length of the hull, but as far as possible the angle should be calculated so that no panels extend at an angle which is more than 180°. In the hull illustrated in FIG. 9 the panels mainly extend at an angle of about 130°–140°.

Figure 10:
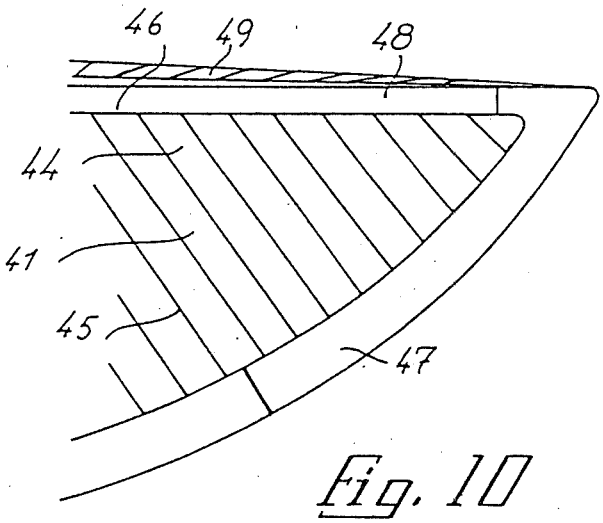
FIG. 10 shows details of the bow of a boat hull.
Figure 11:
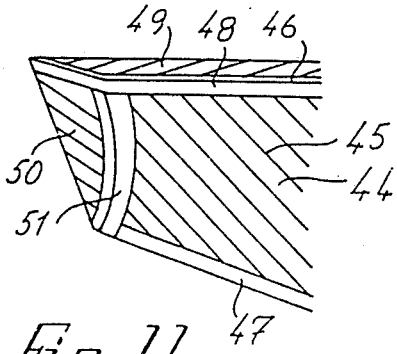
FIGS. 11 and 12 show details of the stern of a boat hull.
Figure 12:
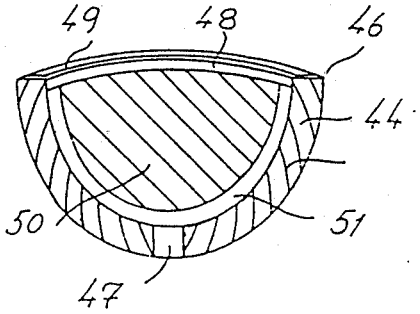

The hull may be assembled so that the hull panels 44 extend round the entire hull from one boarder 46 thereof to the opposite border whereby a hull type having a substantially round bottom is obtained. The panels, however, can be joined at a larger or lesser angle at the bottom of the hull by means of a separate keel plate 47 as shown in FIG. 10. The keel plate 47 preferably is composed of several parts which are connected to each other, and it should be formed according to the intended keel profile in the longitudinal direction and the cross direction of the hull. Like in conventional boat hull types the keel may be pointed at the stem and be more rounded or flat further down towards the keel.

At borders the hull may be formed with a border plate, for instance an angle border plate 48 which with one branch thereof is connected to the hull panels 44 and with the other branch is connected to similar panels 49 forming the deck of the boat. Also the border plates 48 may be injection molded of aluminum.

Also at the stern the hull may be formed with stern panels 50 of the same type as the hull panels 44 and the deck panels 49, and the stern panels 50 may be joined to the hull panels 44 by means of an angle stern profile 51 of the same type as the border plate 48.

Figure 13:
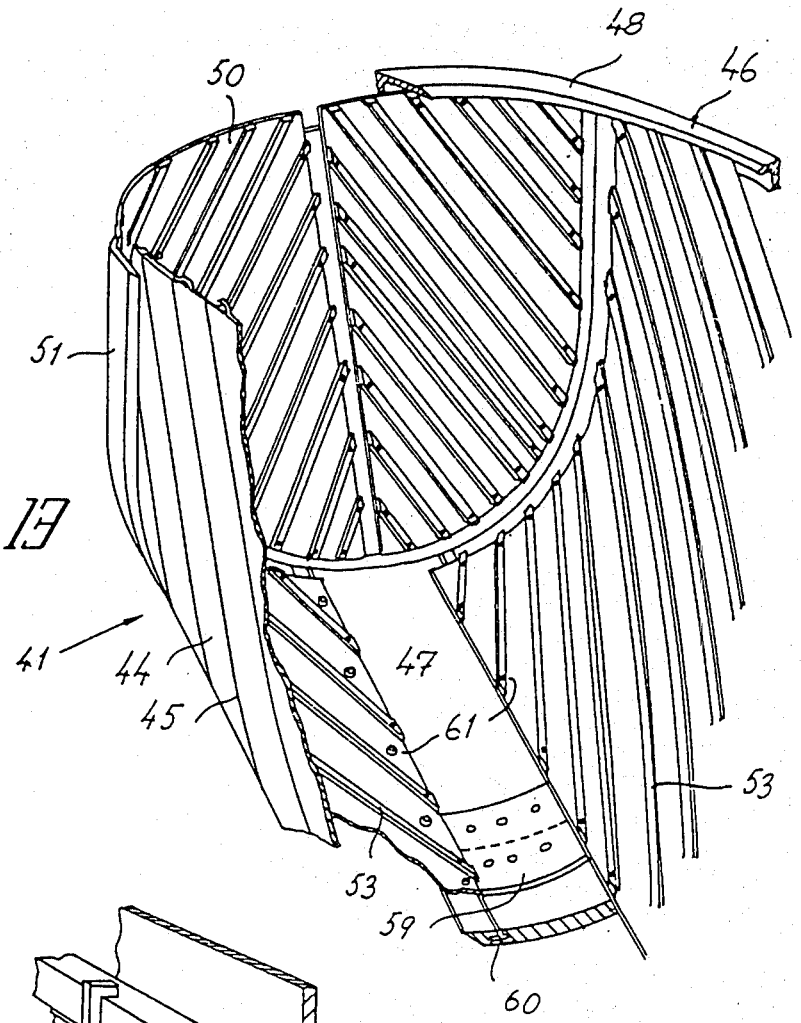
FIG. 13 diagrammatically and fragmentary shows some details of a boat hull structure according to the invention seen from inside.

As mentioned above the hull structure may be built in a concave form, on a convex plug, on frames or free supporting as diagrammatically illustrated in FIG. 13, by means of auxiliary frames which after the final assembling are removed. The hull may be built in any other way known to the expert.

Figure 14:
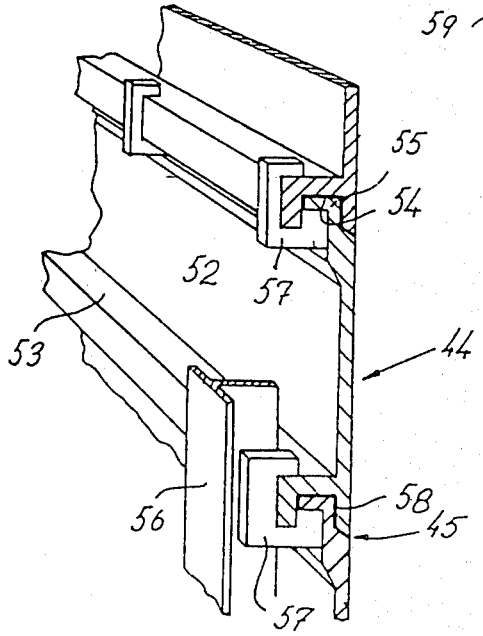
FIG. 14 diagrammatically shows the method of joining panels in a hull structure according to the invention.

One example of a panel for hull, deck or stern is shown in FIG. 14. The said panel comprises a central plane or panel portion 52 which along one longitudinal edge has an angle extension 53 providing an outwards directed U-formed groove 54 and which along the opposite longitudinal edge has a tongue 55 for interaction with the groove 54. The tongues 55 are at last partly narrower than the groove 54, in order to allow ribs or wedges to be forced into the groove portion thereby pressing groove and tongue together in a panel parallel with and perpendicular to the plane of the panel. For maintaining the panels interconnected and used as a mounting point between the shell of the hull and possible frames 56 as shown in FIG. 14 G-like clips 57 can be used. The G-clips embrace the angle extension 53 and extend into the remaining open portion of the groove 54. The frames 56 may be mounted in the G-clips by means of bolts, screws, rivets or by any other means. Oppositly the G-clips 57 may be mounted at those places where frames, bulkheads or similar means are present so that the shell is fixed mounted thereto. The G-clips are mounted after the tongue is introduced in the groove, and between the G-clips 57 the above mentioned ribs or wedges may be introduced in the remaining portion of the groove.

The G-clips may be formed in different ways. In FIG. 16 is shown a G-clip which is formed as two halves, one half 57 a engaging underneath the angle extension 53 and the tongue 55 whereas the other half 57*b* engages on top of the angle extension 53. The two halves 57*a* and 57*b* are connected by means of rivets or bolts, possibly by the interaction of a frame 56. In order to give a sealed and strong structure the groove and tongue and any other parts of the panel may be joined by means of a glue joint 58. Of course the glue 58 should have a high shearing strength. The glue may be liquid or a film or a foil which is applied between the joints of the panel. As examples of suitable types of glue may be mentioned ephoxy glue, phenol glue, polyurethan glue, polyamide glue, phenol-vinyl glue, phenol-nitrile glue and ephoxy-polyamide glue. A specially preferred glue is a film of ephoxy-polyamide (Nylon) which has a shearing strength of up to 400 kp/cm$^2$ and which is recommended for strongly loaded structures.

In FIG. 13 is shown a typical example of a hull structure according to the invention in which the hull panels or the shell panels 44 are assembled to a shell which at the inside provides a rib-like pattern of angle extensions 53 and tongues 55 connected thereto providing a solid reinforcement in the intended polar angle of between 90° and 180° as seen in the hull moving direction. In the case illustrated in FIG. 13 the hull is formed with a keel plate 47 to which the shell is screwed or mounted in any other way. The keel plate 47 can be made in several sections which are joined by means of a joint plate 59.

As best evident from FIG. 15 T-formed grooves 60 are provided adjacent the two side edges of the keel plate. In said grooves 60 bolts 61 can be moved to a suitable position. The border panels 44 are mounted at the inside of the keel plate 47 by means of the bolts 61 of the keel plate. The bolts may be provided to extend to the angle extensions 53 or at any other suitable places along the central panel portion 52. Similar to the longitudinal T-grooves 60 of the keel plate the border plate 58 can be formed with a longitudinal T-groove 62 between the shell and the deck both for mounting of the border panels 44 and the deck panels 49. Likewise the stern profile 51 can be formed with T-grooves for the border panels 44 and the stern panels 50.

As mentioned above frames 16, bulk heads or any other cross extending and supporting means can be mounted inside the hull, but for many purposes the hull alternatively may be free supporting. In order to avoid buckling or any other adverse change of form of the panels special support profiles 63 may be used as shown in FIG. 17. The said profiles are provided alternatively or supplementary to the G-clips 57 and so as to engage over the angle extension 53 and in the groove 54 and also to engage behind the adjacent support profile or a G-clip 57 at the opposite edge of the panel. The support profiles 63 may be provided at any place where there is a risk that the hull is subjected to extra large strains or where there is a risk of buckling in case very thin panels are used. Like the G-clips the support profile and any other inner means can be mounted after the hull is assembled.

Figure 18:
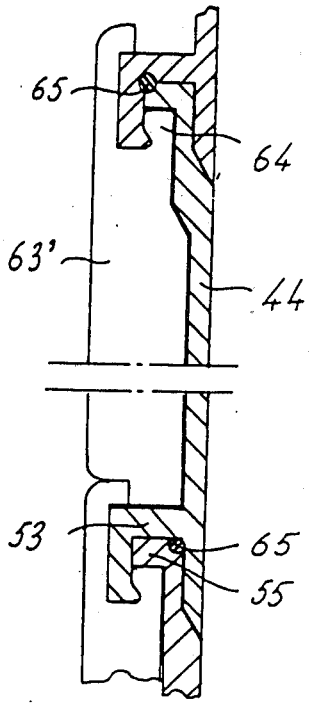
FIG. 18 shows in the same way as in FIG. 17 a modified embodiment of a connection and reinforcing means.

In FIG. 18 is shown a modified embodiment of the support profile 63' in which the web portion of the support profile is widened so as to engage the entire inner surface of the border panel. Such support profiles 23' therefore are used for strongly loaded structure or parts of the hull structure. In FIG. 18 also is shown how the projecting locking pin 64 of the support profile 63' and the tongue of the boarder panel or any other parts of the structure may be formed with recesses in which separate sealing ribs 65 for instance of rubber may be provided upon demand.

Figure 19:
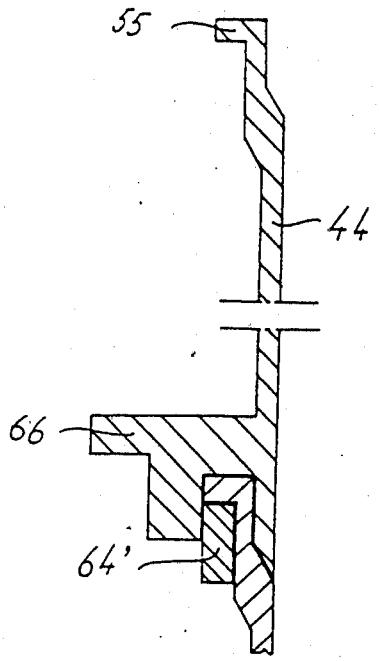
FIG. 19 shows a varied form of a panel for use in connection to the invention, and FIG. 20 diagrammatically shows a tube made by the method according to the invention.

FIG. 19 shows a border panel which is modified so that the lower portion 66 of the panel providing the U-formed groove is made essentially stronger than the previously described corresponding portions and which can be used for direct mounting of frames, bulk heads and all kinds of other means.

Figure 20:
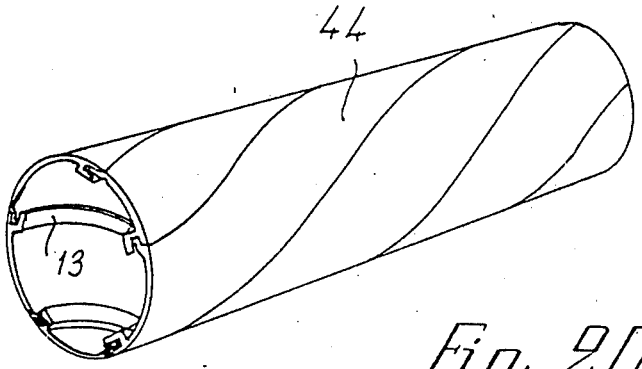

FIG. 20 diagrammatically shows the method of fabricating a tube in accordance with the invention from border panels 44. The panels may be provided in the longitudinal direction of the tube or in spiral form as shown in the drawing. The groove and tongue portions may be provided either at the interior of the tube or at the exterior of the tube and between said portions insulating material may be provided. If the groove and tongue portions are provided at the interior of the tube the particular advantage is obtained that the said portions subject the flow of flood to an advantageous screw movement thereby providing a quick laminary flow. Tubes of this kind can be used both for liquids and gases as for instance water tubes, drainage tubes, oil, gas transport tubes, chimneys etc.

If it is wanted to form the integral body or hull with outer or inner additional portions like a keel of a boat hull such portions are made separately and mounted by means of bolts in the keel plate 47 or directly on the border panels 44.

It is to be understood that the above specification and the embodiments of the invention illustrated in the drawings are only illuminating examples and that all kinds of different modifications of the method and apparatus may be presented within the scope of the appended claims. For instance the profile may be locked to each other in the screws, rivets, pins or similar means are introduced between the web portion 14 of the female connection means 4 and the foot 10 of the male connection means 8. Such portions may be predrilled for the pin, the screw or the similar means, but it is sufficient that only one part is predrilled so that a locking is provided in that the material of the other part is deformed. A locking is even possible by deforming the material straight through both parts.

I claim:

1. Method of fabricating an integral shell formed body having a substantially even and smooth outer surface from several elongated panels comprising:

providing each of the panels with a substantially U-formed groove element (6) along one longitudinal edge, the groove element being offset from the main plane of the elongated panel and extending in the longitudinal direction of the panel and having a tongue groove of selected depth and width defined therein, providing each of the panels with a tongue element (8) to mate with the groove of a similar adjacent panel along the other longitudinal edge, the tongue element (8) being offset from the main plane of the panel in the same manner as the groove element and being formed with a leg portion (9) and a foot portion (10), the length of the leg portion being substantially the same as the depth of the groove adjacent the main plane of the panel and being narrower than the width of the groove to thereby define a clamp groove (12) between the tongue and groove elements when mated in interengaging relationship;

introducing the tongue element (8) of one panel into the groove of another panel with the leg portion (9) in contact with and pressed against one side (7) of the groove (6) extending in the longitudinal direction thereof adjacent the main plane of the panel, and with the foot portion (10) in contact with and pressed against the bottom (14) of the tongue groove;

mounting at least one clamp block (13, 17) in the clamping groove (12) adjacent the tongue element (8) so as to press the tongue element toward both the bottom (14) of the tongue groove and the side of the groove adjacent the main plane (5) of the panel, whereby the main planes of the interconnected panels provide a substantially smooth and even surface at the side opposite the offset tongue and groove elements.

2. A method according to claim 1 in which the integral shell formed body is a hull structure especially for water-or-air supported conveyances provided with a closed hull body (41) wherein the hull panels (44, 49, 50) are formed according to an intended bow-shape hull profile and are mounted at an angle of 90 to 180 degrees relative to a polar plane in which the normally strongest loaded direction of conveyance movement is 90 degrees in the polar plane and wherein additional steps comprise mounting the panels (44, 49, 50) one by one and securing the panels by means of one or more clamp blocks (13, 17, 29, 30, 57) to provide a closed and sealed hull body.

3. A method according to claim 1 wherein a plurality of clamp blocks are introduced into the clamp groove (12) and at least some of the blocks are mounted on runners or frames (22) of the shell.

4. A method according to claim 1 wherein a plurality of clamp blocks are introduced into the clamp groove (12) and at least two of the clamp blocks have a G-shape, and the step of mounting includes mounting the G-shaped clamp blocks so as to enclose the outer side (11) and at least a part of the bottom (14) of the structure defining the groove element (6) to press the tongue element (8) against the bottom and the side of the clamp groove (12), the G-shaped clamp blocks (17) being spaced from each other along the U-formed groove element, and a further step includes inserting additional clamp blocks (13) in the clamp groove (12) between said G-shaped clamp blocks (17).

5. A shell-formed body comprising:

a plurality of elongated panels (1, 2, 3), each of which having a U-formed groove element (6) with a tongue groove along one longitudinal edge, and a tongue element (8) along the opposite longitudinal edge, the width of the tongue element along at least a part thereof being substantially less than the width of the groove in the groove element (6) to thereby provide a clamping groove (12) when the tongue element of one panel is introduced into the groove element of another similar panel, the groove element being offset from the main plane of the elongated panel and extending in the longitudinal direction of the panel, the tongue element (6) being likewise offset from the main plane of the elongated panel so that two assembled panels define a smooth, even, and preferably continuous outer surface oppositely disposed from the groove and tongue elements, the tongue element having a leg portion (9), the length of which is substantially the same as the depth of the tongue groove formed in the groove element (6) adjacent the main plane of the panel, and the width of which is less than the width of the groove in the groove element, and a foot portion (10), the width of which is substantially less than the width of the groove in the groove element (6) thereby defining a clamp groove (12) between the tongue and groove elements (6, 8) in assembled relationship, the leg portion (9) of the tongue element (8) being designed to engage the side (7) of the groove in the groove element, and the foot portion (10) being designed to engage the bottom of the groove of the groove element (6); at least one clamp block (13, 17, 29, 30) having a clamping portion with a width not less than the width of the clamp groove (12) being introduced into the clamp groove between the tongue and groove elements (8) to press the leg portion (9) of the tongue element (8) into butting engagement with the side of the groove in the groove element (6) and to press the foot portion (10) of the tongue element (8) into butting engagement with the bottom (14) of the groove, the clamp block also including means for securing the block in the clamp groove (12).

6. A shell formed body according to claim 5 wherein the groove element (6) is an integral part of the panel (1, 2, 3) projecting from the inner side of the panel and defining the outer side (7) of the tongue groove along the main plane (5) of the panel, the bottom (10) and inner side (11) of the groove being defined by a portion of the element projecting from the main plane (5) of the panel.

7. A shell formed body as defined in claim 6 further including a continuous length of clamp block (13) mounted along the entire length of the clamp groove (12) defined between the tongue and groove elements (6, 8).

8. A shell formed body as defined in claim 6 wherein clamp blocks (13) are mounted at spaced intervals along the clamp groove (12) of each tongue and groove element (6, 8), and interposed between the clamp blocks (13) are G-shaped clamps (17) enveloping the inner side (11) of the groove structure and at least part of the bottom (14) thereof.

9. A shell formed body as defined in claim 8 wherein the G-shaped clamp is a multi-part structure (29, 30) in which one of the structure parts (29) has a clamp block portion and an outer wall (18′), and the other structure part (30) has an outer wall and a top branch (19′) to engage the outer surface of the bottom (10) of the groove structure (6), and portions of the multi-part structure (29, 30) are adapted to be interconnected by mechanical means (31) when mounted in the tongue and groove elements (6, 8).

10. A shell formed body as defined in claim 8 wherein the G-shaped clamp blocks (17, 29, 30) are mounted on frame portions of the shell body extending transversely of the elongated panels.

11. A shell formed body according to claim 5 especially designed as a hull structure for water or air conveyances wherein the panels are bow shaped according to the intended hull formation and are placed at an angle of 90–180 degrees as viewed in a polar angle coordinate system in which the normally greatest loaded direction of the hull body or the normal hull moving direction is 90 degrees.

12. A shell formed body as defined in claim 5 wherein glue means (15) is provided between the engaging surfaces of the tongue and groove elements (6, 8), the glue being activated to set, preferably upon application of heat, after several panels have been connected together.

* * * * *